US005370489A

United States Patent [19]

Bagrosky

[11] Patent Number: 5,370,489

[45] Date of Patent: Dec. 6, 1994

[54] BINDING PERFORATED SHEETS

[75] Inventor: Frank Bagrosky, Marlboro, N.Y.

[73] Assignee: James Burn International Limited, United Kingdom

[21] Appl. No.: 62,429

[22] Filed: May 17, 1993

[30] Foreign Application Priority Data

May 18, 1992 [GB] United Kingdom ..... 9210553.5

[51] Int. Cl.[5] ..... B42B 5/10

[52] U.S. Cl. ..... 412/39; 412/13

[58] Field of Search ..... 412/7, 12, 13, 16, 39, 412/40, 33

[56] References Cited

U.S. PATENT DOCUMENTS

| | | | |
|---|---|---|---|
| 3,667,076 | 6/1972 | Aglaghanian et al. | 412/39 |
| 4,020,516 | 5/1977 | Gomez | 412/39 |
| 4,155,134 | 5/1979 | Pfaffle | 412/39 X |
| 4,558,981 | 12/1985 | Fabrig | 412/7 |
| 4,610,590 | 9/1986 | Pigna | 412/7 X |
| 4,874,279 | 10/1989 | Pfaffle | 412/39 |

*Primary Examiner*—Mark Rosenbaum
*Assistant Examiner*—S. Thomas Hughes
*Attorney, Agent, or Firm*—Wood, Herron & Evans

[57] ABSTRACT

A machine for binding sets of sheets with a wire binding element of the kind having a series of curved prongs with points and roots. The machine comprises a holding mechanism for holding the binding element in a predetermined position. A selectively movable guide plate is located adjacent to and at a constant preset distance from the binding element points. The guide plate is also located to receive perforated edges of the sheets thereagainst so that the sheets' perforations can be aligned with the points in order to aid in guiding the perforated sheets into assembly with said binding element. A first adjustment mechanism is provided for moving the guide plate relative to the binding element points. The first adjustment mechanism permits the position of said guide plate to be adjusted relative to the points so as to maintain the constant pre-set distance between said guide plate and the points for any sized binding element.

9 Claims, 5 Drawing Sheets

BINDING PERFORATED SHEETS

BACKGROUND OF THE INVENTION

1. Field of the Invention

This invention relates to apparatus for binding pads of perforated sheets to book form, such as, for example, notebooks, calendars, instruction manuals and the like, with wire binding elements.

2. Description of the Prior Art

The wire binding elements for use with such apparatus are formed from a length of wire which is bent to form a series of curved, hair-pin shaped prongs. Each prong has a closed end, or "point", an open end, or "root", and a curved wall therebetween. The curvature of the prongs is such that the element has the appearance of an open-sided cylinder with a substantially C-shaped cross-section. Such binding elements will hereinafter be described as "binding elements of the type described".

To bind pads of perforated sheets to book form, a binding element of the type described is cut to a predetermined length and a pad of perforated sheets is moved relative to the binding element, or vice versa, so that the points of the binding element pass through the perforations. The binding element is then closed to ring shape by bringing its points into the vicinity of its roots thereby binding the pads.

The step of aligning the pad of perforated sheets with the binding element and moving the pad so that the points of the binding elements pass through the perforations is commonly carried out automatically, see for example our prior British Patent No. 2213769. However, apparatus which can carry out this step reliably is complicated and expensive. Furthermore, it is often a requirement to bind pads of differing sizes with binding elements of varying sizes and apparatus which can meet this requirement is yet more complicated and expensive.

SUMMARY OF THE INVENTION

It has been proposed to supply binding apparatus in which at least the step of inserting the open binding elements into the perforations of a pad of sheets to be bound is carried out manually. Such apparatus is cheaper to produce than a fully automatic binding machine but leads to difficulty for the user, firstly in inserting the parts of the binding element into the perforations in the sheets to be bound and, secondly, in adjusting the apparatus for differing sizes of binding elements.

Apparatus for binding pads of perforated sheets with wire binding elements of the type described in accordance with the invention comprises means for supplying a predetermined length of binding element to an insertion station, means for conveying a pad of perforated sheets having a binding element inserted through the perforations of the pad from the insertion station to a binding station and means for closing the binding element thereby binding the pad to book form, wherein the insertion station comprises means for holding the binding element in a predetermined position relative to a guide plate against which the edge of the pad of perforated sheets adjacent the perforations may be engaged to align the perforations with the points of the binding element present at the insertion station, so that the pad may readily be moved manually to a position in which the points of the binding element pass through the perforations. The guide plate in use may extend at least partially within the binding element and be pivotable about an axis substantially parallel to the axis of the binding element. The guide plate may be adjusted so that the perpendicular distance between the guide plate and the points of the binding element remains constant for different sizes of binding element.

With such an apparatus, the manual steps of aligning the perforations with the points of the binding element and of moving the pad so that the points pass through the perforations, may be carried out relatively quickly and repeatedly. Since the other steps in the binding operation may be carried out automatically, the throughput of the apparatus which is dictated by the skill and dexterity of the operator in carrying out the manual steps is significantly increased. The guide plate may be readily pivoted to accommodate pads having perforations located at different distances from the edge of the pad. In embodiments in accordance with the invention a binding rate in the region of 1000 pads of perforated sheets per hour has been achieved, the maximum binding rate being dependent upon the manual dexterity of the operator.

Preferably the means for holding the binding element comprises a retainer plate parallel to the axis of the binding element and a transverse plate parallel to the axis and perpendicular to the retainer plate, the plates being disposed so that the roots and at least a part of the wall of the binding elements are supported in such a position that the binding element is correctly positioned relatively to the guide plate. Means may me provided to adjust the retainer plate and the transverse plate to accommodate different sizes of binding element and to hold such binding elements in the correct position to receive pads of perforated sheets.

In such an arrangement, the apparatus may be rapidly adjusted so as to accommodate different sizes of binding element. The axis about which the guide plate is pivotable may suitably be fixed relative to the retainer plate.

The retainer and transverse plates may be connected by a pivoting linkage member, the arrangement being such that as the retainer plate is adjusted, the transverse plate moves in the same direction by a distance a predetermined ratio of the distance moved by the retainer plate. The adjustment of the holding means to accommodate binding elements of different sizes within the insertion station may be quickly and easily carried out in apparatus in accordance with the invention, by pivoting the linkage member by a set amount.

Means in the form of a toothed belt may be provided to convey the binding element into the insertion station. The belt assists in the accurate positioning and holding of the binding element within the insertion station.

The dimensions and/or the pitch of the teeth of such a belt may be such that a single toothed belt may be used with a variety of sizes of binding element.

Means may be provided to align at least one end of the edge of the pad of perforated sheets with the binding element in the insertion station. Such an arrangement enables the perforations in the pad of sheets to be aligned more easily and more rapidly with the points of the binding element.

BRIEF DESCRIPTION OF THE DRAWINGS

An embodiment of the invention will now be described by way of example and with reference to the accompanying drawings, in which.

DESCRIPTION OF THE PREFERRED EMBODIMENT

Figure 2:
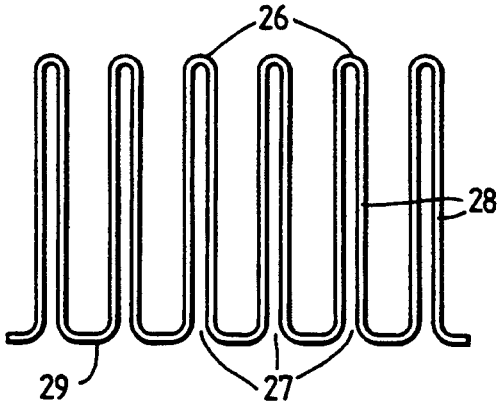
FIG. 2 shows a length of metal wire from which binding elements of the type described are made.
Figure 3:
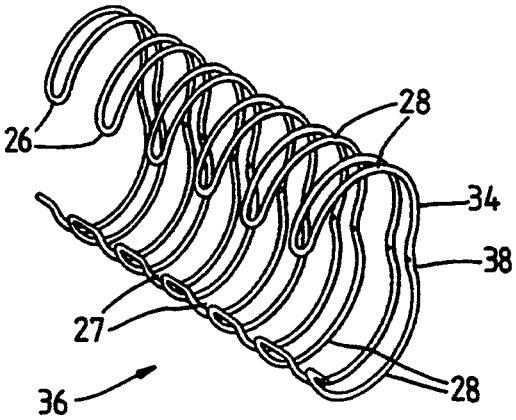
FIG. 3 shows the wire of FIG. 2 shaped into a binding element of the type described.

Referring firstly to FIGS. 2 and 3, the metal wire to be used as a binding element is bent to form a series of curved hair-pin shaped prongs 28 having straight sections 29 therebetween. Each prong 28 has a point 26 and a root 27. The binding element 36 is curved to have a substantially C-shaped cross-section and forms an open-sided cylinder. The cylinder has a wall 34 opposite its open side and a depression 38 in the wall 34 running along the axial length of the binding element 36.

Figure 1:
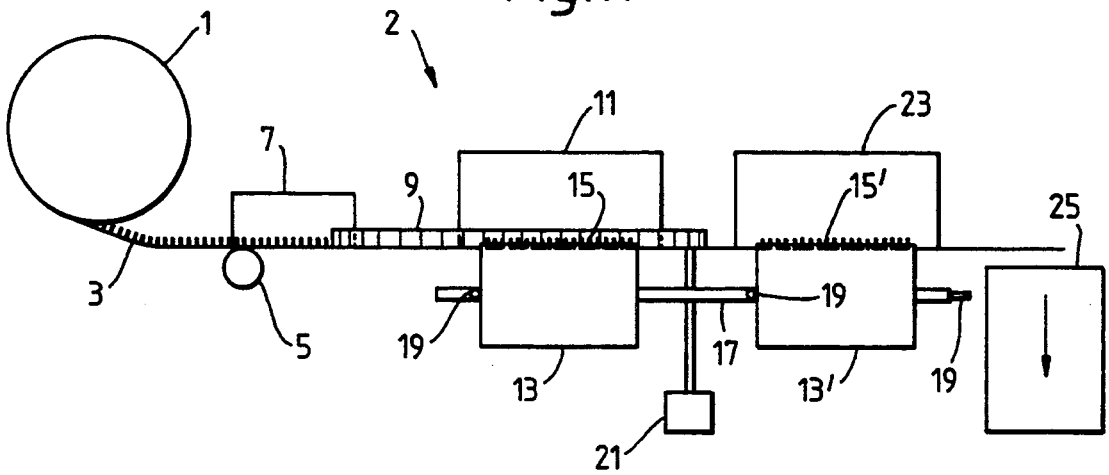
FIG. 1 is a schematic view of an embodiment of apparatus in accordance with the invention.

The apparatus shown schematically in FIG. 1 comprises a spool 1 of binding element 3 of the type described which is fed into a measuring and cutting device 7 by means of a sprocket 5. The device 7 measures a predetermined length of binding element and cuts it to a predetermined length. The cut length 15 of binding element is then conveyed to an insertion station 11 by means of an endless double-toothed belt 9 driven by a motor 21. When the length 15 of binding element is correctly positioned within the insertion station 11, a pad 13 of perforated sheets is moved by the operator so that the points 26 of the length 15 of binding element pass through the perforations along the edge of the pad. The insertion station 11 will be described further below. The pad 13 having the length 15 of binding element inserted is then moved out of the insertion station 11, firstly by the toothed belt 9 and secondly by an endless pusher belt 17 having a number of pusher members 19.

The pusher belt 17 is driven by the same motor 21 and at the same rate as the toothed belt 9. The pad 13 and length 15 of binding element are then moved into the binding station 23 to the position indicated at 13',15' by the pusher belt 17. At the binding station 23, the length 15' of binding element is closed to ring shape by pressing it between two platens, as will be described below, thereby binding the pad 13' to book form.

The pusher belt 17 then conveys the bound pad 13',15' out of the binding station towards a conveyor 25 which then removes the bound pad 13',15' from the area of the apparatus 2 in the direction indicated by the arrow. Any other suitable device (not shown) for use in the finishing of the bound pad 13',15', such as a cover turning unit, a shrink-wrapping unit, a boxing unit, a packing unit, or a combination of these, may be provided. In which case a suitable replacement of the conveyor 25 may also be provided.

The apparatus 2 is configured so that the operations at the measuring and cutting device 7, at the insertion station 11, and at the length 15 of binding station 23 are carried out simultaneously as pads 13 and binding element move through the apparatus. The feed of lengths 15 of binding element to the insertion station 11, and pads 15 into and through the apparatus is interrupted by the operator, by means of a foot pedal (not shown), so as to permit the operator time to carry out the insertion operation at the insertion station 11. Alternatively these feeds may be interrupted. The apparatus may also be halted to enable the operator to make adjustments so that different sizes of pad and/or of binding element may be accommodated in the apparatus 2.

The individual features of the measuring and cutting device 7 and the binding station 23 are known per se and do not individually constitute part of this invention.

Figure 4A:
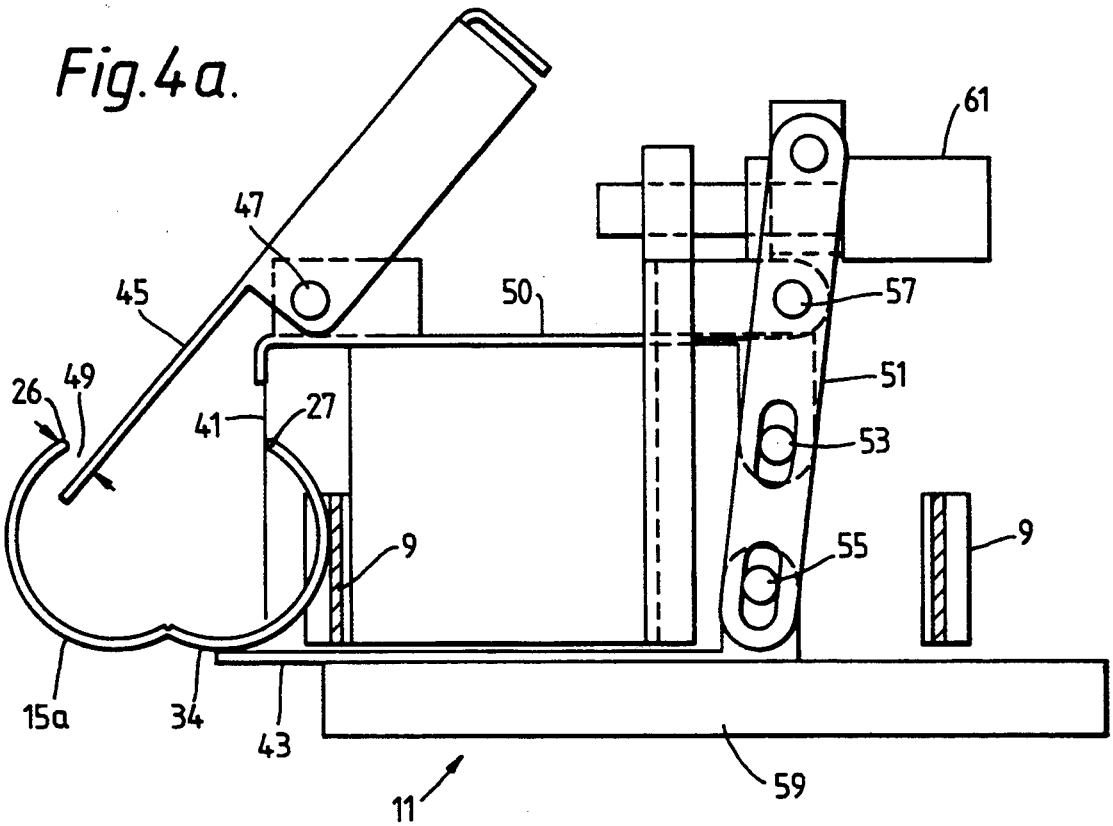
FIGS. 4*a*, 4*b* and 4*c* are enlarged views of part of the apparatus of FIG. 1 showing different sizes of binding element of the type described within the insertion station.
Figure 4B:
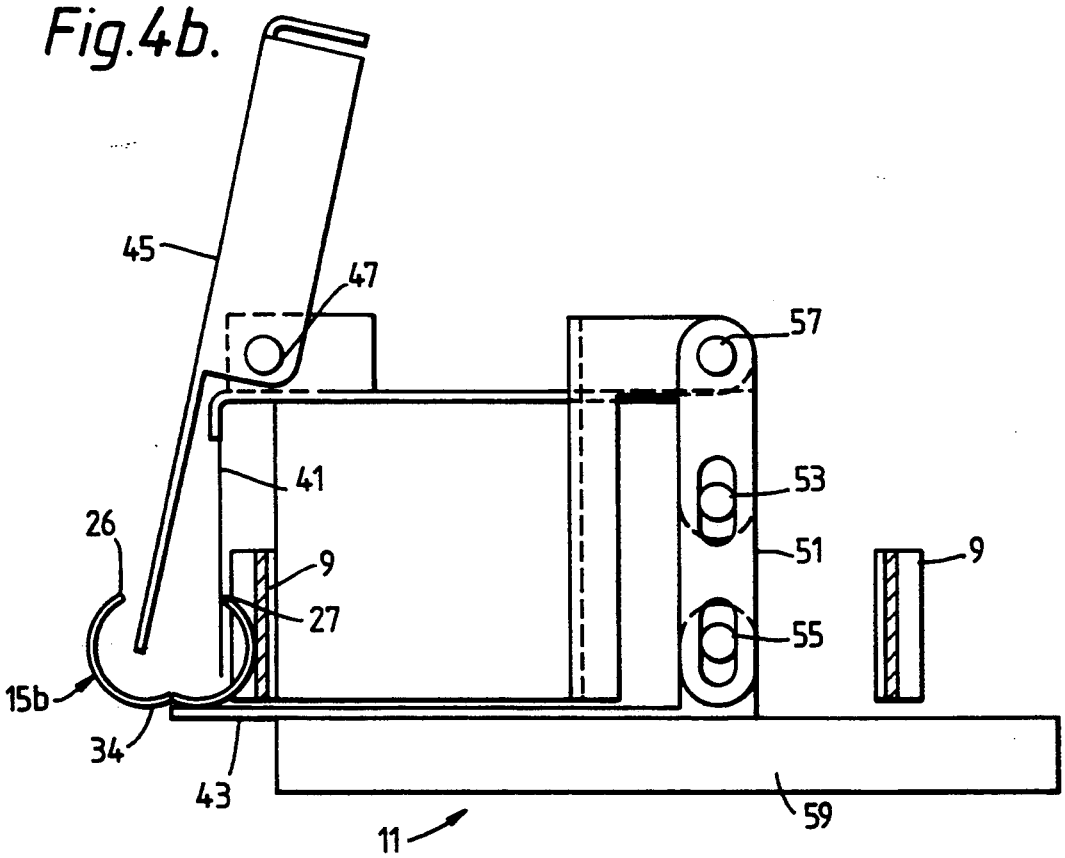
Figure 4C:
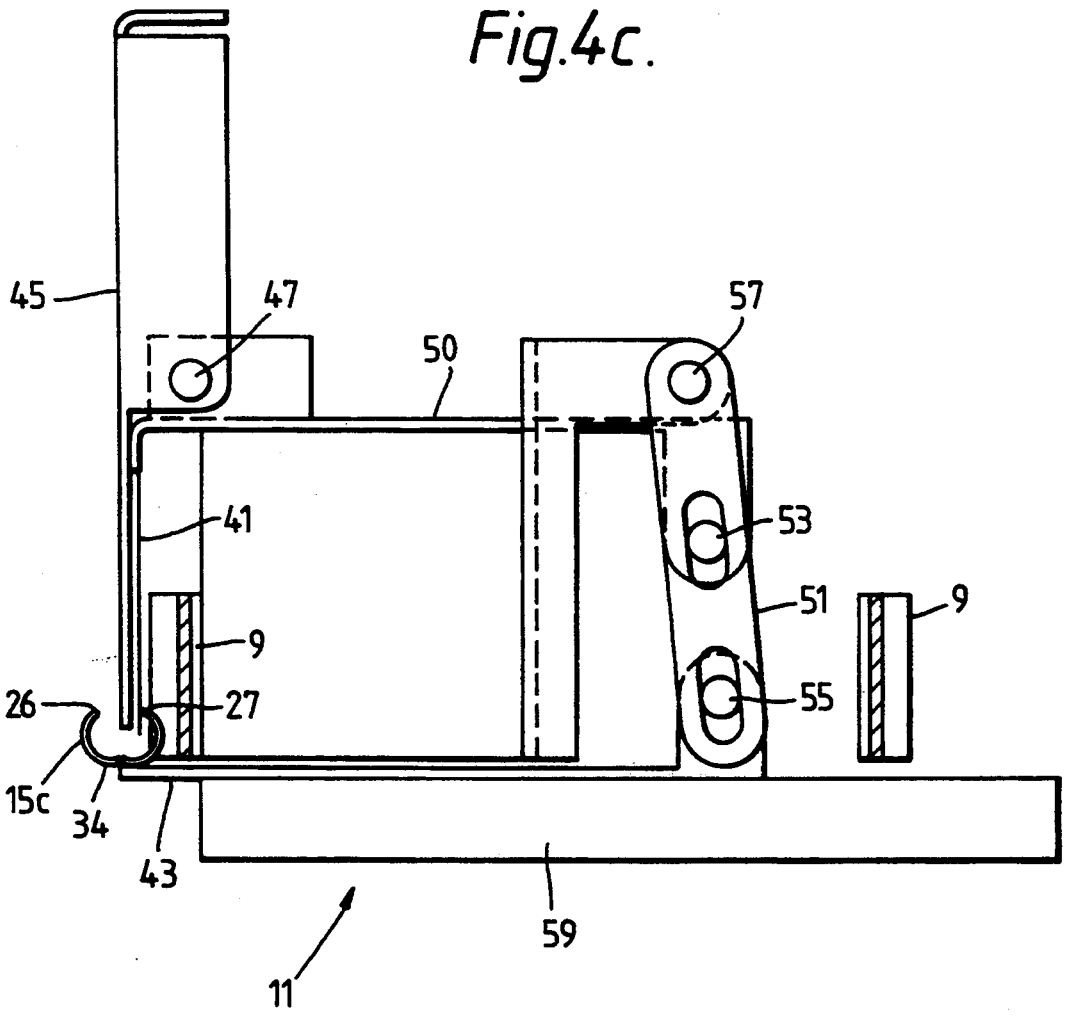

FIGS. 4*a*, 4*b* and 4*c* show in greater detail, the insertion station 11 with different diameters of wire binding element 15*a*,15*b*,15*c* contained therein. All other references are common to each of FIGS. 4*a*,4*b* and 4*c*.

A length 15*a* of binding element has been moved into the insertion station 11 by toothed belt 9, the teeth of which engage the element between the prongs 28, and the roots 27 and part of the wall 34 of the length 15 of binding element are supported between toothed belt 9, which is supported by a fixed backing plate 42, retainer plate 41 and transverse plate 43. A guide plate 45 extends within the space enclosed by the binding element and is pivoted about axis 47. The guide plate 45 is rotated about the axis 47 so that the perpendicular distance 49 between the guide plate 45 and the points 26 of the binding element is equal to the distance between the edge of the pad 13 of perforated sheets and the perforations. In adjusting the insertion station 11 so as to accommodate binding element of different sizes (1 capacity, ½ capacity, 3/16 capacity, for example) the guide plate 45 may be pivoted about the axis 47 so that the distance 49 remains constant, as shown in FIGS. 4*a*,4*b* and 4*c*. In use, the operator brings the edge of a pad 13 of perforated sheets to be bound (see also FIG. 1) into contact with the guide plate 45 so that the pad is substantially perpendicular thereto and slides the pad along the guide plate 45 towards the points 26. The pad is then lifted over the binding element with the points 26 passing through the perforations. The pad 13 and the length 15 of the binding element are then conveyed out of the insertion station 11 by the toothed belt 9 and, via an idle station 20, into the binding station 23 (see FIG. 1) by the pusher belt 17 (FIG. 1) as described below. The pusher belt 17 preferably operates cyclically moving the pad 13 a set distance each cycle.

The retainer plate 41 has an extension member 50 connected to a linkage member 51 by a sliding pivot 53. The transverse plate 43 is connected to the linkage member 51 by a further sliding pivot 55. The linkage member 51 is pivoted about a fulcrum 57 which is fixed in relation to the base 59 of the installation station 11. The distance between the sliding pivots 53,55 is such that as the linkage member 51 is rotated, the retainer plate 41 moves in the same direction as the transverse plate 43 and by a distance which is a predetermined ratio of the distance moved by the transverse plate 43 so as to accommodate different sizes of binding element between the retainer plate 41, the toothed belt 9 and the transverse plate 43 (see FIGS. 4*b*,4*c*).

An adjustment device 61 (shown in FIG. 4*a* only) is provided to pivot the linkage member 51 about the fulcrum 57, and this adjustment device 61 may have indicators or stops (not shown) so that the linkage member 51 may be rapidly moved between the positions necessary to accommodate particular sizes of binding element in the correct position in the insertion station.

The axis 47 about which the guide plate 45 is pivoted is fixed in relation to the extension member 50.

Figure 5:
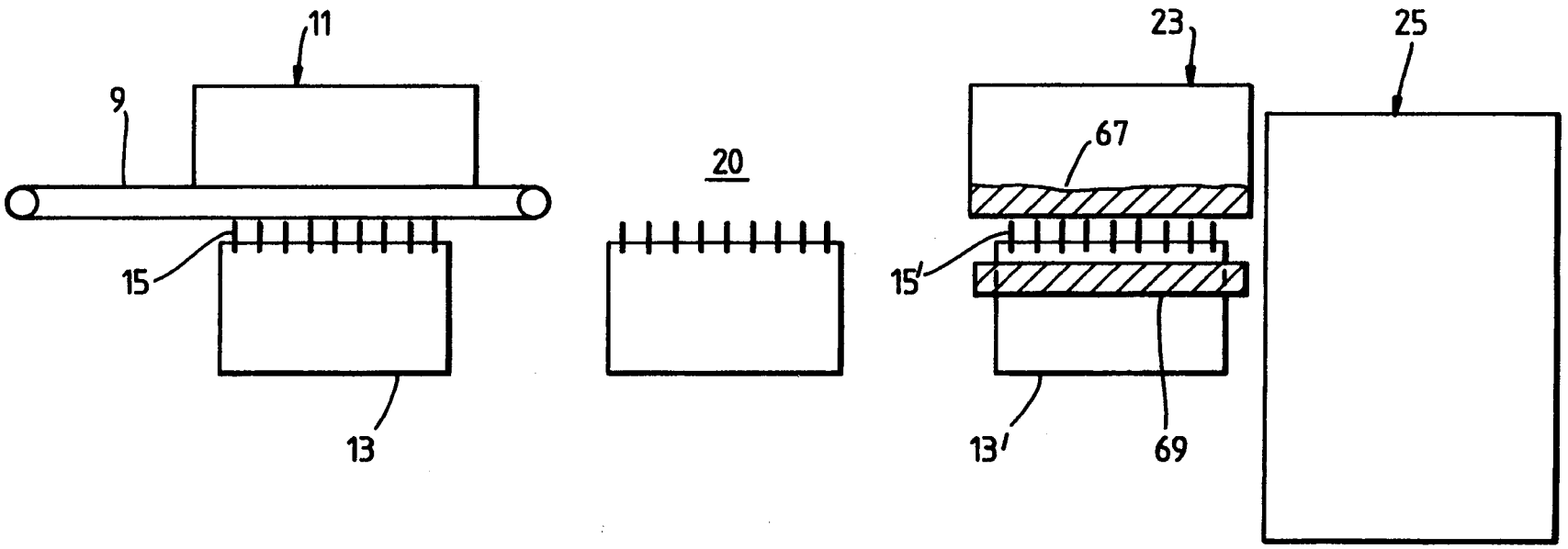
FIG. 5 is a detailed plan view of part of the apparatus of FIG. 1 showing the means for conveying the pad and the length of wire binding element from the insertion station to the binding station.

Referring now to FIG. 5, the means for conveying the pad 13 with the length 15 of wire binding element inserted through the perforations from the insertion station 11 to the binding station 23 is shown. For clarity, the pusher belt 17 is not shown. Once the operator has moved the pad 13 so that the points 26 of the length 15 of wire binding have passed through the perforations, the operator releases the pad 13 which is then moved out of the insertion station 11 by the toothed belt 9 and the pusher belt (not shown). As the operator releases the pad 13 it is allowed to fall under its own weight so that it hangs at an angle of about 60° to the plane of FIG. 5 so that it rotates about, and hangs from, the length 15 of binding element (as shown in FIG. 6), which is prevented from rotating by the retainer plate 41, transverse plate 43 and the toothed belt 9.

Figure 6:
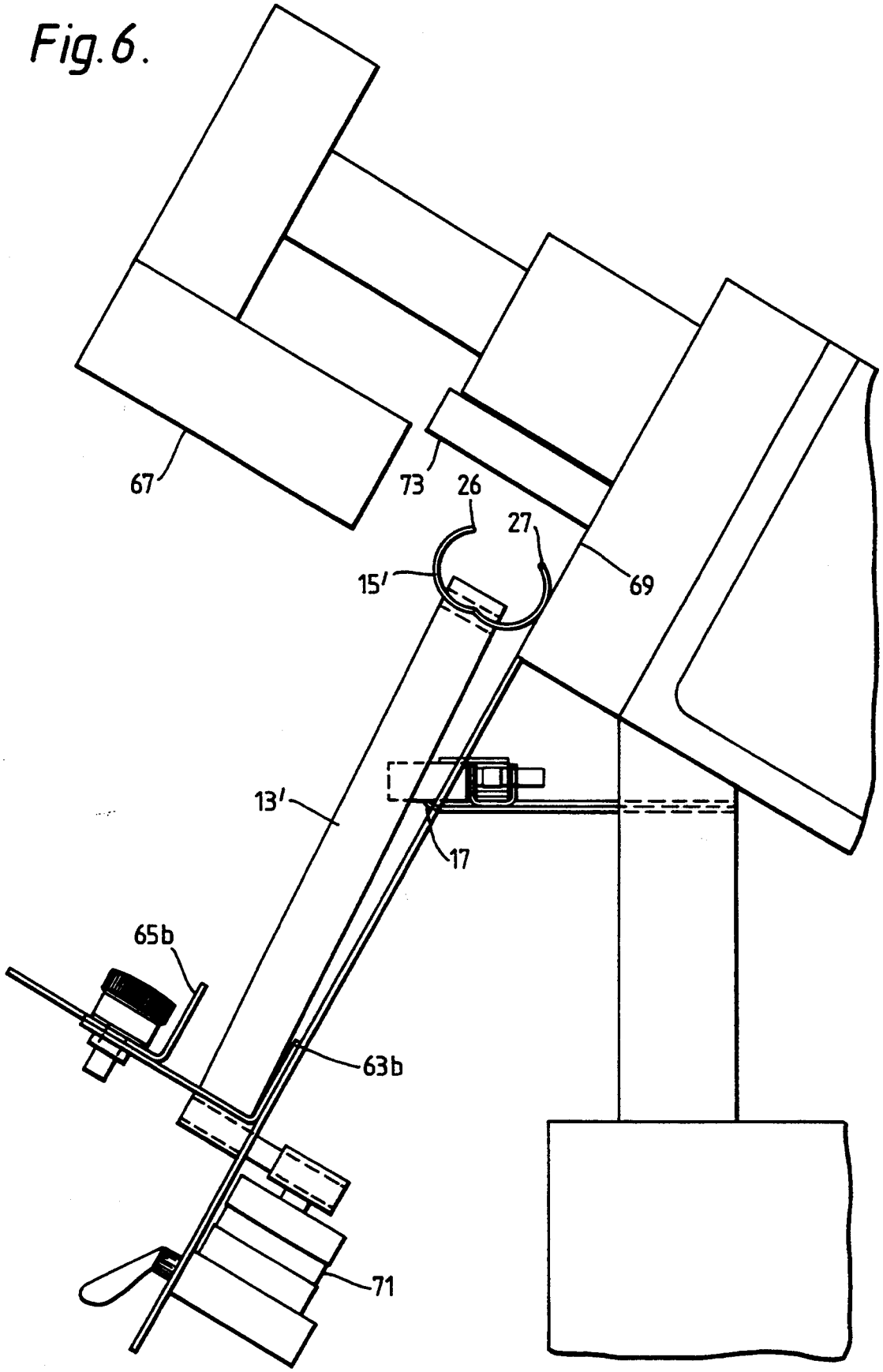
FIG. 6 is a detailed view of the binding station of FIG. 1.

As the pad 13 and the length 15 of binding element are conveyed out of the insertion station 11 with the pad 13 hanging from the length 15 of binding element, the pad 13 is guided between a lower set of guide members **63*b*,65*b* (see FIG. 6). One or both guide members is movable to accommodate different thicknesses of pad 13**.

Referring to FIGS. 5 and 6 the pad 13 and the length 15 of binding element are conveyed to the binding station 23 by the pusher belt 17 to the position shown at 13',15' where the binding element is closed to ring form by pressing it between a reciprocating platen 67 and a fixed platen 69, thereby binding the pad 13' to book form. Once the pad 13' has been bound, it is moved out of the binding station by the pusher belt 17 (not shown) onto the conveyor 25.

At the binding station 23, a cylinder 71 is either manually or automatically operable to lift the pad 13' and element 15' so that the points 26 and roots 27 of the element 15' are pressed firmly against a backstop 73, the element 15' then being firmly held between the backstop 73 and the Perforations in the pad 13' whilst the element 15' is closed between the platens 67,69.

I claim:

1. A machine for binding sheets with a wire binding element of the kind having a series of curved prongs which define plural points and plural roots at a predetermined pitch, said curved prongs being defined by a wall of generally C-shaped cross section with a longitudinal axis, said sheets each having perforations along an edge thereof and being bound upon closing said points into the vicinity of said roots, said machine comprising:

holding means for holding said binding element in a predetermined position, a selectively movable guide plate located adjacent said binding element points and at a constant preset distance from said points, said guide plate being located to receive said sheets' perforated edges thereagainst so that said sheets' perforations can be aligned with said points in order to aid in guiding said perforated sheets into assembly with said binding element, and first adjustment means for moving said guide plate relative to said binding element points, said first adjustment means permitting the position of said guide plate to be adjusted relative to said points so as to maintain said constant pre-set distance between said guide plate and said points for any of plural sizes of said binding element.

2. A machine as set for in claim 1, said first adjustment means comprising a pivot joint connected to said guide plate, said pivot joint defining a pivot axis parallel to and spaced from said longitudinal axis of said binding element.

3. A machine as set for in claim 2, said holding means comprising a retainer plate parallel to said binding element's longitudinal axis, and a transverse plate parallel to said binding element's longitudinal axis and perpendicular to said retainer plate, said retainer plate and said transverse plate being disposed so that said roots and at least a part of said wall of said binding element are supported such that said binding element is correctly positioned relative to said guide plate.

4. A machine as set forth in claim 3, said machine further comprising second adjustment means for moving said retainer plate and said transverse plate to accommodate plural sizes of said binding element in order to hold any size of said binding element in the correct position to receive said perforated sheets.

5. A machine as set forth in claim 4, said pivot axis being fixed in position relative to said retainer plate.

6. A machine as set forth in claim 5, said second adjustment means comprising a pivot linkage that connects said retainer plate and said transverse plate, said pivot linkage causing said transverse plate to move in the same direction as said retainer plate by a distance equal a predetermined ratio of the distance moved by the retainer plate when said retainer plate is adjusted.

7. A machine as set forth in claim 4, said machine further comprising motion means to move said binding element into an insertion position adjacent said guide plate.

8. A machine as set forth in claim 7, said motion means comprising a toothed belt where the distance between adjacent teeth of said belt is equal to one of the pitch of said binding element and a multiple thereof.

9. A machine as set forth in claim 7, said machine further comprising means to align at least one non-perforated edge of a pad of said perforated sheets with said binding element when said binding element is in said insertion position.

* * * * *

UNITED STATES PATENT AND TRADEMARK OFFICE

CERTIFICATE OF CORRECTION

PATENT NO. : 5,370,489

DATED : December 6, 1994

INVENTOR(S) : Frank Bagrosky

It is certified that error appears in the above-indentified patent and that said Letters Patent is hereby corrected as shown below:

At column 5, line 40 please delete "Perforations" and insert in its place -- perforations --

At column 6 line 40 please delete "equal a" and insert in its place -- equal to a --

Signed and Sealed this

Twenty-first Day of March, 1995

*Attest:*

Bruce Lehman

BRUCE LEHMAN

*Attesting Officer*

*Commissioner of Patents and Trademarks*